US005242495A

United States Patent [19]

Hammond et al.

[11] Patent Number: 5,242,495

[45] Date of Patent: Sep. 7, 1993

[54] COMBINED JOINT COMPOUND BUCKET AND TAPE DISPENSER

[76] Inventors: Scott Hammond; Maggie Hammond, both of 5101 James St., E. Syracuse, N.Y. 13057

[21] Appl. No.: 916,640

[22] Filed: Jul. 22, 1992

[51] Int. Cl.[5] ..... B05C 3/172

[52] U.S. Cl. ..... 118/43; 118/40; 118/405; 118/419; 118/423; 156/527; 156/575; 156/577; 221/135

[58] Field of Search ..... 118/40, 43, 405, 419, 118/423, 428, DIG. 17; 156/527, 575, 577; 221/135; 206/411

[56] References Cited

U.S. PATENT DOCUMENTS

| | | | |
|---|---|---|---|
| 1,572,063 | 2/1926 | Black | 118/43 |
| 2,499,017 | 2/1950 | Callaway et al. | 118/405 |
| 2,679,232 | 5/1954 | Brown | 118/43 |
| 2,876,730 | 3/1959 | Moore | 118/43 |
| 3,112,225 | 11/1963 | Harms | 118/43 |
| 3,496,909 | 2/1970 | Bennett, Jr. | 118/43 |
| 3,913,522 | 10/1975 | Light | 118/43 |
| 4,996,941 | 3/1991 | Mills | 156/577 |

*Primary Examiner*—Peter Chin
*Assistant Examiner*—Todd J. Burns
*Attorney, Agent, or Firm*—Katherine McGuire

[57] ABSTRACT

A combined joint compound bucket and tape dispenser comprising a cylindrical container with a removable cover. A roll of dry-wall construction tape is suspended at the top of the container beneath the cover by a rod extending through the center of the tape and engaging slots in opposite sides of the container. The container includes two slotted apertures on one side of the container and a third slotted aperture on the other side of the container. The tape is reeled from the rod, out through a first aperture, guided down along the outside of the container, back into the container at the second aperture adjacent the bottom of the container. The tape passes through mud deposited in the container and exits the container on the opposite side through the third aperture. The tape is thus coated with the mud and may be torn from the container on a serrated edge at the desired lengths. A removable guide rail is also provided to guide the tape from the first to the second apertures.

9 Claims, 1 Drawing Sheet

COMBINED JOINT COMPOUND BUCKET AND TAPE DISPENSER

BACKGROUND OF THE INVENTION

This invention relates to the dry-wall construction art and, more particularly, to an improved bucket for containing joint compound including means for coating and dispensing tape therefrom.

In the dry-wall construction art, it is typical to apply a coating of joint-compound or "mud" to tape which is used to cover the seams and joints formed between adjoining walls of sheet-rock. It is convenient to use a container for the mud which also includes means for supporting a roll of tape, guiding the tape through the mud and dispensing it from the container at the desired length with the tape coated in the mud. Upon a search of the art, the following patents were discovered which disclose various types of such containers:

U.S. Pat. No. 3,496,909, issued to L. Bennett, Jr. on Feb. 24, 1970 discloses an open trough for containment of the mud including a pair of spaced arms extending from one side thereof between which a roll of tape is supported. The tape is directed along the bottom of the trough and exits the opposite end thereof whereupon it is coated with the mud and may be torn away at the desired length.

U.S. Pat. No. 3,112,225, issued to Harms on Nov. 26, 1963, discloses a hand-held tape and mud dispenser where the roll of tape is supported by a yoke attached to the bottom of a triangular-shaped mud container.

U.S. Pat. No. 3,913,522, issued to Light on Oct. 21, 1975, discloses a container for holding the mud and a roll of tape submerged therein wherein the tape is directed under and around guide rods positioned beneath the roll of tape with the coated tape extending upwardly and out of a slot in the container cover.

U.S. Pat. No. 2,876,730, issued to Moore on Mar. 10, 1959, discloses tape coating apparatus which removably attaches to the rim of a mud bucket. The apparatus comprises an elongated frame which includes portions extending into the bucket including a tape support rod supporting a roll of tape above the bucket opening. The tape is directed to extend into the bucket along the frame and exit through a slot in the frame engaging the rim of the bucket whereupon it has been coated in the mud and may be torn off at the desired length.

Other patents showing variations of the same type of apparatus are as follows:

U.S. Pat. No.2,763,237, issued to Harris on Sep. 18, 1956.

U.S. Pat. No. 2,679,232, issued to Brown on May 25, 1954.

U.S. Pat. No. 3,023,728, issued to Ort on Mar. 6, 1962.

U.S. Pat. No. 3,342,160, issued to Weeks on Sep. 19, 1967.

It is a principle object of the present invention to provide apparatus for holding a quantity of joint compound or "mud" (as it is referred to in the art) which includes means to support and dispense a roll of tape at selective lengths, the tape being directed through and therefore coated by the mud in condition for applying it to a dry-wall joint or seam.

It is another object of the present invention to provide a mud bucket and tape dispenser of the above type which is easy to handle and move about; prevents the mud in the bucket from drying out; and supports and dispenses the tape therefrom in an efficient manner.

It is a further object of the present invention to provide a mud bucket and tape dispenser of the above type which is of simple design and construction and otherwise economically attractive.

Other objects will in part be obvious and in part appear hereinafter.

SUMMARY OF THE INVENTION

In accordance with the foregoing objects, the invention comprises a container of generally cylindrical configuration although the container may preferably be of square or other configuration as desired. The container includes a bottom and side walls with an open top. A removable cover is also provided. A pair of diametrically opposed slots are formed in the walls of the container at the top. A roll of tape having an open center is slidingly mounted to a rod which is removably positioned in the slots of the container such that the roll of tape is supported at the center of the open top end of the container. The cover includes a cooperatively formed raised portion to accommodate the upper half of the roll of tape when the cover is attached to the container.

The container further includes three slotted apertures wherethrough the tape extends to be coated in mud placed inside the container. The slots are positioned such that the tape exits the container through a slot adjacent the top rim of the container; extends downwardly along the side of the container and enters through a second slot formed in the side wall adjacent the bottom of the container. The tape extends across the inside bottom of the container (and hence through mud deposited in the bucket) and exits therefrom through a third slot formed in the side wall of the container opposite the second slot. A serrated blade projects from the side wall of the container immediately below the third slot so that the coated tape may be torn therefrom at the desired length.

An arcuate guide rail is provided and may be snap fit at opposite ends thereof into grooves located immediately below and above the first and second slots, respectively. The tape rides over the rail as it extends from the first to second slots and prevents the tape from ripping before it exits the container at the third slot. It is of course intended that the tape be fed through all three slots before any mud is deposited in the container.

DETAILED DESCRIPTION

Figure 1:
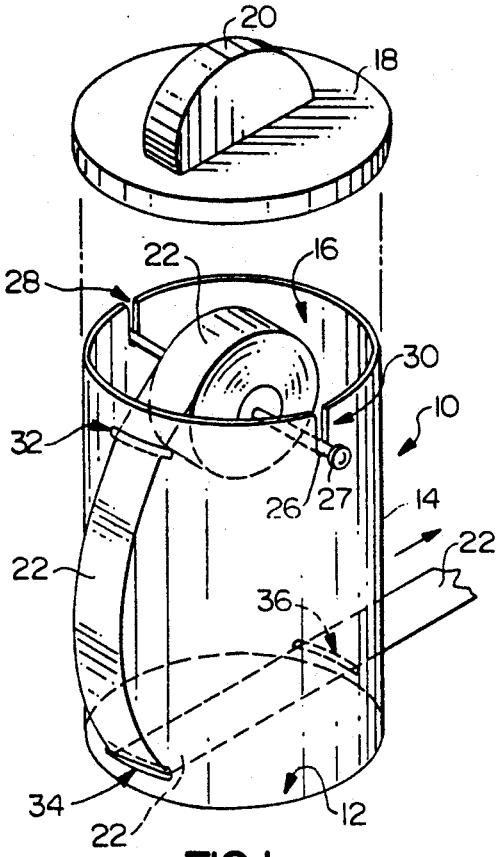
FIG. 1 is a perspective view of the mud container with cover spaced thereabove and showing a roll of tape supported at the open top with the tape extending through the three slots in the intended manner for dispensing tape coated in mud.

Referring now to the drawings, there is seen in FIG. 1 a container 10 of generally cylindrical configuration having a bottom wall 12 with side wall 14 extending upwardly therefrom to form a circular open top 16. Although a cylindrical container 10 is shown and described herein, the configuration of container 10 may be varied as desired or required.

Figure 2:
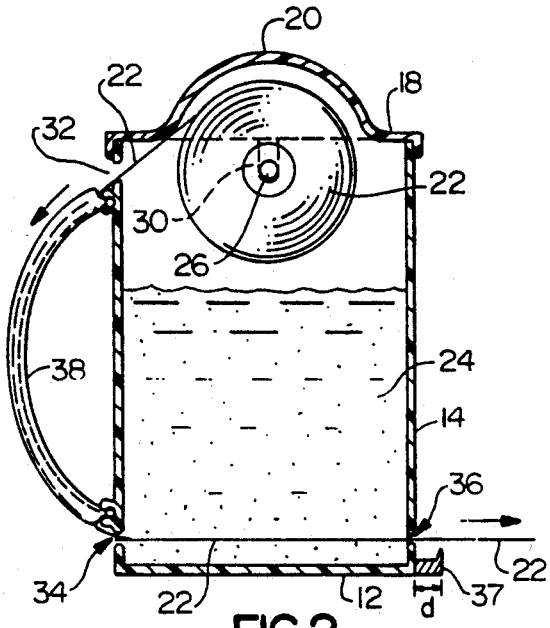
FIG. 2 is a cross-sectional, side elevational view of the container and cover and further showing the guide rail over which the tape extends as it travels from the first to second slots.

A removable cover 18 is provided having a raised, hollow half-moon 20 at its center to accommodate a roll of tape 22 seen at open top 16 when cover 18 is secured to container 10 as seen in FIG. 2.

Prior to depositing a quantity of dry-wall mud 24 in container 10, tape roll 22 is suspended at open top 16 by a rod 26 which is passed through the open center of the roll of tape 22 and engaged at opposite ends thereof in slots 28 and 30 formed on opposite sides of wall 14. A removable nut 27 is provided at either end of rod 26 to prevent rod 26 from falling through slot 30 or 28 and into the container 10. The leading end of tape 22 is fed through a first slotted aperture 32 formed in side wall 14 adjacent open top 16, directed downwardly along the outside of wall 14, and inserted through a second slotted aperture 34 formed below slotted aperture 32 adjacent bottom 12. Tape 22 is directed along the inside of container 10 at bottom 12 and exits container 10 at third slotted aperture 36 located opposite second aperture 34 in wall 14.

With tape 22 fed through the three apertures 32, 34 and 36 in the manner described above, a quantity of mud 24 is deposited in container 10 and cover 18 is secured to container 10 at open top 16. Tape 22 is reeled from rod 26 as it is pulled from aperture 36 with a film of mud 24 disposed thereon and may be torn off at any desired length. In this respect, a serrated, elongated blade 37 is mounted to side wall 14 immediately below slotted aperture 36 to facilitate the tearing off of tape 22. Blade 37 is seen to be spaced a distance d from wall 14 such that the terminal end of tape 22 will project a distance from aperture 36 permitting tape 22 to be easily grasped and pulled therefrom.

Figure 3:
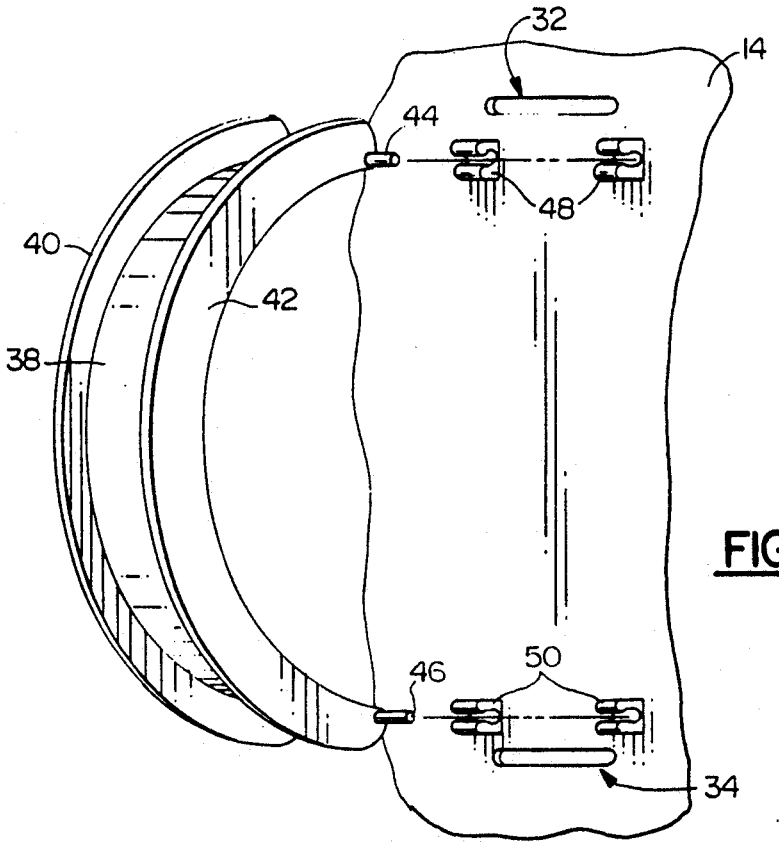
FIG. 3 is an enlarged, broken-away, perspective view of the guide rail shown detached from the container.

As seen in FIGS. 2 and 3, a guide rail 38 of arcuate shape is provided to removably attach to container 10. Rail 38 is seen to include side flanges 40 and 42 wherebetween tape 22 extends as it travels from aperture 32 to aperture 34. Rail 38 further includes two pairs of posts 44 and 46 which project laterally from the top and bottom ends of flanges 40 and 42, respectively. (The posts on flange 40 are not shown in the drawings). Two pairs of retaining clips 48 and 50 are anchored to side wall 14 adjacent and below first aperture 32 and adjacent and above second aperture 34, respectively, whereby posts 44 and 46 may be snap fit into retaining clips 48 and 50, respectively, as seen in FIG. 2. Rail 38 smoothly guides tape 22 from aperture 32 to aperture 34 thereby substantially reducing breakage of tape 22 before it exits aperture 36.

What is claimed is:

1. Apparatus for containing a quantity of joint compound including means for coating and dispensing a roll of tape having a central opening, said apparatus comprising:

a) a container having a bottom wall and a side wall extending upwardly therefrom to define an open top;

b) first, second, and third slotted apertures formed in said side wall, said first slotted aperture positioned adjacent said open top, said second slotted aperture positioned below said first slotted aperture adjacent said bottom wall, said third slotted aperture positioned diametrically opposite said second slotted aperture adjacent said bottom wall; and c) means for rotatably supporting said roll of tape in said open top above said bottom wall and said joint compound, said tape consecutively exiting said container through said first aperture, extending downwardly along said side wall, entering said container through said second aperture, passing through said joint compound and exiting said container through said third aperture whereupon said tape is coated in said joint compound.

2. The container of claim 1 wherein said tape support means comprises:

a) first and second, diametrically opposed slots formed in said side wall adjacent said open top; and b) an elongated rod having first and second, opposite ends on which said roll of tape is slidingly and removably mounted through said central opening said rod first and second ends being removably positioned in said first and second slots, respectively.

3. The invention according to claim 2 wherein said rod includes removable portions at said first and second ends, said portions having maximum diameters larger, than said opposed slots.

4. The invention according to claim 2 and further comprising a cover removably secured to said container at said open top with said roll of tape and said support means positioned between said cover and said bottom wall above said joint compound.

5. The invention according to claim 4 wherein said cover includes a raised, hollow protrusion wherein a portion of said roll of tape fits when said cover is secured to said container.

6. The invention according to claim 5 and further comprising means for guiding said tape from said first to said second apertures, said guide means removably connected to said side wall between said first and second apertures.

7. The invention according to claim 6 wherein said guide means comprises an arcuately shaped rail having first and second ends and including first and second, laterally spaced flanges extending from said first to said second ends of said rail along opposite edges thereof and wherebetween said tape extends as said tape travels from said first aperture to said second aperture.

8. The invention according to claim 7 wherein said means removably connecting said guide means to said side wall comprises:

a) first and second pairs of posts extending laterally outwardly of said rail, said first pair of posts extending in opposite directions from outer surfaces of said first and second flanges, respectively, at said first end of said rail and said second pair of posts extending in opposite directions from outer surfaces of said first and second flanges, respectively, at said second end of said rail; and b) first and second pairs of retaining clips fixedly mounted to said side wall between said first and second, slotted apertures, said first pair of retaining clips being laterally spaced and positioned adjacent and below said first slotted aperture, said second pair of retaining clips being laterally spaced and positioned adjacent and above said second slotted aperture, said first and second pairs of posts being frictionally removably engaged in said first and second pairs of retaining clips, respectively.

9. The invention according to claim 8 and further comprising an elongated, serrated blade mounted parallel to and spaced from said side wall adjacent said third aperture.

* * * * *